US009669915B1

(12) United States Patent
Won et al.

(10) Patent No.: US 9,669,915 B1
(45) Date of Patent: Jun. 6, 2017

(54) BOAT CONTROL SYSTEM USING JOYSTICK

(71) Applicant: LGM CO., LTD., Anseong-si, Gyeonggi-do (KR)

(72) Inventors: Jun Hee Won, Seoul (KR); Jinhyung Bae, Anseong-si (KR)

(73) Assignee: LGM CO., LTD., Anseong-si, Gyeonggi-do (KR)

( * ) Notice: Subject to any disclaimer, the term of this patent is extended or adjusted under 35 U.S.C. 154(b) by 0 days.

(21) Appl. No.: 15/222,509

(22) Filed: Jul. 28, 2016

(51) Int. Cl.
*B63H 21/21* (2006.01)
*B63H 20/00* (2006.01)

(52) U.S. Cl.
CPC ..... *B63H 21/213* (2013.01); *B63H 21/265* (2013.01)

(58) Field of Classification Search
CPC ..... B63H 21/213; B63H 21/265
See application file for complete search history.

(56) References Cited

U.S. PATENT DOCUMENTS 8,593,265 B1 * 11/2013 Dornfeld ..... G08C 17/00 182/127
2002/0018049 A1 * 2/2002 Love ..... G06F 1/1616 345/161
2005/0275624 A1 * 12/2005 Chadha ..... G05G 1/025 345/156
2011/0172858 A1 * 7/2011 Gustin ..... B63H 21/213 701/21
2015/0246716 A1 * 9/2015 Skauen ..... G05G 9/047 440/40

FOREIGN PATENT DOCUMENTS

KR 10-2014-0134768 A 11/2014

* cited by examiner

*Primary Examiner* — Stephen Avila
(74) *Attorney, Agent, or Firm* — Novick, Kim & Lee, PLLC; Sang Ho Lee

(57) ABSTRACT

Provided is a boat control system using a joystick, which includes a boat body (10); an outboard unit (20) coupled to a rear portion of the boat body (10); a control device (30) configured to control the outboard unit (20) so that the boat body (10) runs; and a joystick (40) wirelessly connected to the control device (30), the joystick being configured to be gripped and manipulated by a fisherman, wherein the joystick (40) includes a communication unit (41) configured for wireless connection to the control device (30); a control input unit (42) configured to input a control signal to the control device (30); and a locking unit (43) configured to determine whether or not to activate the control input unit (42) or the communication unit (41).

3 Claims, 2 Drawing Sheets

BOAT CONTROL SYSTEM USING JOYSTICK

TECHNICAL FIELD

The present disclosure relates to a boat control system using a joystick, and more particularly, to a boat control system using a joystick, which allows a fisherman to minutely control a boat while fishing.

BACKGROUND ART

A fishing boat is generally a small boat for leisure. A fishing boat is commonly used for carrying a driver to a fishing point. However, a boat control system using a joystick is generally operated in a calm lake, and bass generally inhabits at a point with a lot of water plant and obstacles. Therefore, for fishing bass, a fisherman should be moved to a point in a quiet and stable way.

Further, since a fisherman grips a fishing rod with one hand, it is not easy for the fisherman to put down the fishing rod and then operate the fishing boat again.

Therefore, there is demanded to develop a dedicated electric boat more suitable for fishing bass.

RELATED LITERATURES

Patent Literature

Korean Unexamined Patent Publication No. 10-2014-0134768 (entitled "Battery cooling system and Electric boat using the same")

DISCLOSURE

Technical Problem

The present disclosure is directed to providing a boat control system using a joystick, which may allow a fisherman to control a boat while fishing.

Technical Solution

In one aspect of the present disclosure, there is provided a boat control system 100 using a joystick, comprising:

a boat body 10;

an outboard unit 20 coupled to a rear portion of the boat body 10;

a control device 30 configured to control the outboard unit 20 so that the boat body 10 runs; and a joystick 40 wirelessly connected to the control device 30, the joystick being configured to be gripped and manipulated by a fisherman, wherein the joystick 40 includes:

a communication unit 41 configured for wireless connection to the control device 30;

a control input unit 42 configured to input a control signal to the control device 30; and a locking unit 43 configured to determine whether or not to activate the control input unit 42 or the communication unit 41.

In addition, when the joystick 40 and the control device 30 are connected to communicate with each other, the outboard unit 20 may be controlled to limit a speed at which the boat body 10 is capable of running.

In addition, the locking unit 43 may be selected from an inclinometer, a fingerprint identification module and a button.

Advantageous Effects

The present disclosure provides a boat control system using a joystick, which allows a fisherman to minutely control a boat while fishing.

BEST MODE

Hereinafter, preferred embodiments of the present disclosure will be described in detail with reference to the accompanying drawings. These embodiments are just for illustrations for a person having ordinary skill in the art to easily implement the present disclosure, but this does not mean that the feature and scope of the present disclosure are limited to these embodiments.

Figure 1:
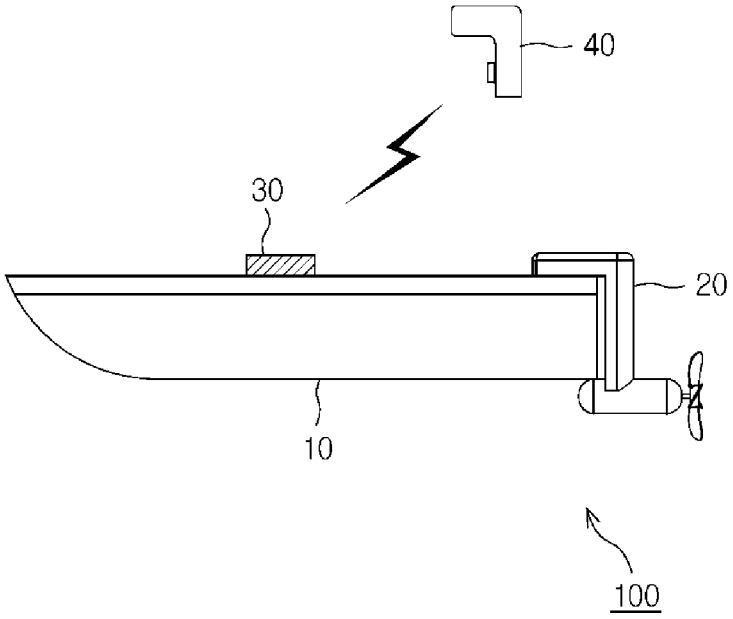
FIG. 1 is a diagram showing a boat control system using a joystick according to an embodiment of the present disclosure.
Figure 2:
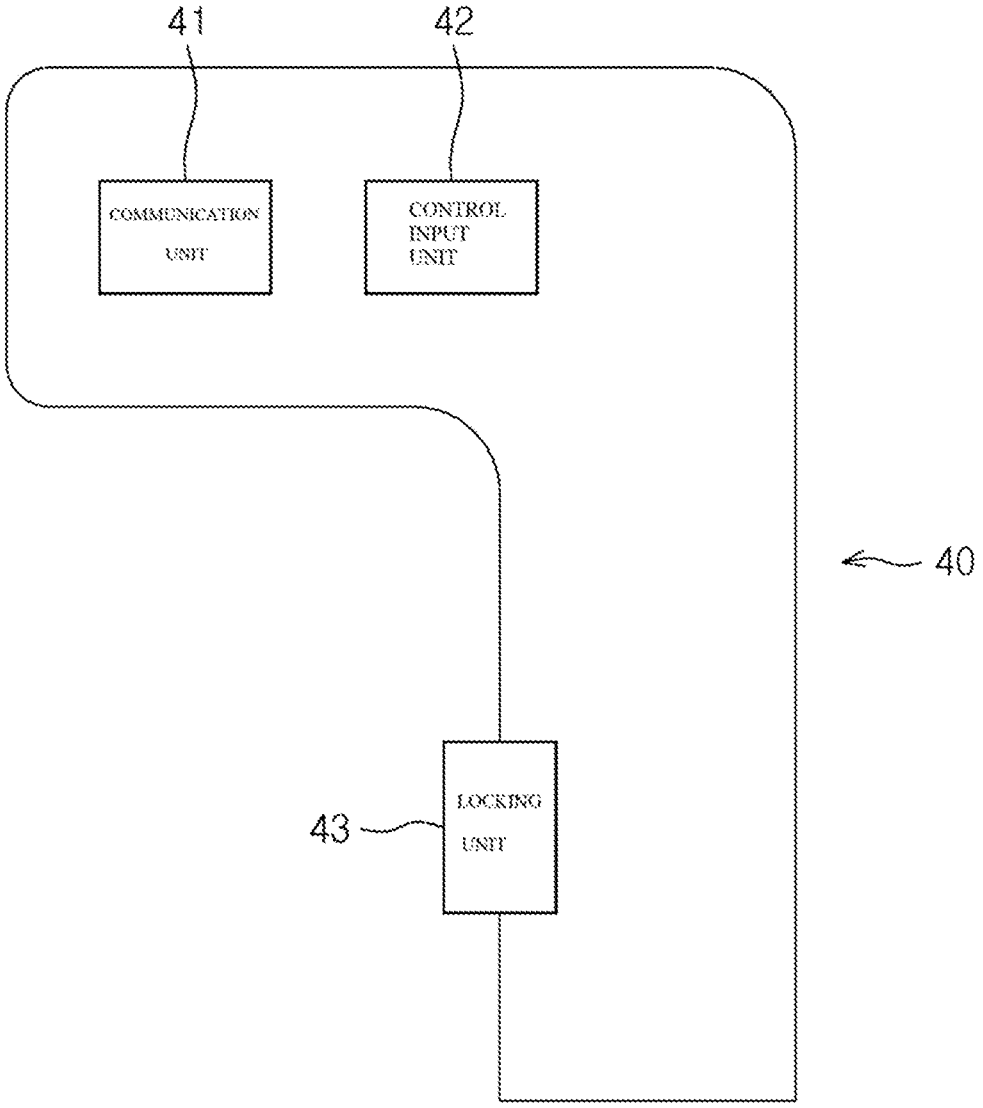
FIG. 2 is a diagram showing a joystick, employed in the boat control system using a joystick according to an embodiment of the present disclosure.

FIG. 1 is a diagram showing a boat control system using a joystick according to an embodiment of the present disclosure, and FIG. 2 is a diagram showing a joystick, employed in the boat control system using a joystick according to an embodiment of the present disclosure.

A boat control system 100 using a joystick according to this embodiment includes:

a boat body 10;

an outboard unit 20 coupled to a rear portion of the boat body 10;

a control device 30 configured to control the outboard unit 20 so that the boat body 10 runs; and a joystick 40 wirelessly connected to the control device 30, the joystick being configured to be gripped and manipulated by a fisherman, wherein the joystick 40 includes:

a communication unit 41 configured for wireless connection to the control device 30;

a control input unit 42 configured to input a control signal to the control device 30; and a locking unit 43 configured to determine whether or not to activate the control input unit 42 or the communication unit 41.

The boat body 10 of this embodiment may have the same shape as a common boat. In addition, the boat body 10 may be made of any material known in the art.

The outboard unit 20 is coupled to a rear portion of the boat body 10 to give a propulsive force for operating the boat body 10. The outboard unit 20 of this embodiment may be composed of a motor which is operated with power received from a battery.

By controlling the power supplied to the motor, the propulsive force of the outboard unit 20 may be controlled minutely.

Meanwhile, the boat control system 100 using a joystick according to this embodiment includes a joystick 40 which may be gripped and manipulated by a fisherman. The joystick 40 may be wirelessly connected to the control device 30 to make local area wireless communication. The outboard unit 20 may be controlled by manipulating the joystick 40, and as a result, the motion of the boat body 10 may be controlled.

In particular, the joystick 40 may be sized and shaped to be manipulated just with one hand. For fishing bass, the boat should move quietly and privately to access a point where the bass inhabits. In addition, a bass fisherman is standing on the boat while holding a fishing rod with one hand. At this time, the fisherman should be able to manipulate the joystick 40 with the other hand to move the boat body 10.

The control device 30 and the joystick 40 may wirelessly communicate with each other by means of Bluetooth or the like. The joystick 40 has a signal input unit which may allow the fisherman to input a signal to the control device 30 in various ways, like a button, a control stick, a touch screen or the like. If a signal is input to the joystick 40 of the control device 30, the control device 30 controls the outboard unit 20. As a result, the motion of the boat body 10 may be controlled. A fisherman may access a point for bass fishing by holding a fishing rod with one hand and manipulating the joystick 40 with the other hand to control the motion of the boat body 10. The control device 30 and the joystick 40 may also communicate with each other by means of a smart phone.

If the joystick 40 and the control device 30 are connected to communicate with each other, the outboard unit 20 may be controlled to limit a speed at which the boat body 10 is capable of running. The boat body 10 is controlled by means of the joystick 40 when the boat body 10 needs to be moved minutely. In addition, since a fisherman manipulates the joystick 40 while standing on the boat body 10, if the boat body 10 moves abruptly, the fisherman may fall down, which may cause an accident. Therefore, in order to protect the fisherman who is standing on the boat, it is required to prevent the boat from being abruptly accelerated, and it is also required to regulate the speed of the boat below a certain level. For example, when the boat body 10 is controlled by means of the joystick 40, a power may be supplied to the outboard unit 20 so that an acceleration does not exceed 1 $m/s^2$. In addition, when the joystick 40 is used, the boat body 10 may be regulated not to run over a speed of 1 m/s.

Controlling the speed of the boat body 10 by means of the joystick 40 is an exceptional case. Therefore, at ordinary time, the joystick 40 is locked by using the locking unit 43. When the joystick 40 is locked, a control signal of the joystick 40 is not transmitted to the control device 30.

The locking unit 43 may be any one of an inclinometer, a fingerprint identification module and a button. In other case, the locking unit 43 may be any one selected from the group consisting of an inclinometer, a fingerprint identification module, a button and combinations thereof. If the locking unit 43 is an inclinometer, the joystick 40 is operated only when the joystick 40 is maintained horizontally to some extent. If the locking unit 43 is a fingerprint identification module, the locking unit 43 is unlocked when a fingerprint of a user is recognized. In addition, if the locking unit 43 is a button, the locking unit 43 is unlocked when the button is pressed.

As described above, by controlling the boat body 10 by means of the joystick 40, a bass fisherman may easily access a point while fishing.

The embodiments of the present disclosure have been described in detail. However, the embodiments are just for illustrations and not intended to limit the scope of the appended claims. Many changes, modifications and equivalents can be made thereto by those having ordinary skill in the art, and such changes, modifications and equivalents also fall within the scope of the present disclosure.

| Reference Symbols | |
|---|---|
| 100: boat control system using a joystick | 10: boat body |
| 20: outboard unit | 30: control device |
| 40: joystick | 41: communication unit |
| 42: control input unit | 43: locking unit |

What is claimed is:

1. A boat control system using a joystick, comprising:

a boat body;

an outboard unit coupled to a rear portion of the boat body;

a control device configured to control the outboard unit so that the boat body runs; and a joystick wirelessly connected to the control device, the joystick being configured to be gripped and manipulated by a fisherman, wherein the joystick includes:

a communication unit configured for wireless connection to the control device;

a control input unit configured to input a control signal to the control device; and a locking unit configured to determine whether or not to activate the control input unit or the communication unit.

2. The boat control system using a joystick according to claim 1, wherein when the joystick and the control device are connected to communicate with each other, the outboard unit is controlled to limit a speed at which the boat body is capable of running.

3. The boat control system using a joystick according to claim 1, wherein the locking unit is selected from an inclinometer, a fingerprint identification module and a button.

* * * * *